United States Patent [19]

Kato

[11] Patent Number: 4,991,388

[45] Date of Patent: Feb. 12, 1991

[54] DRAFT DEVICE IN SPINNING MACHINE

[75] Inventor: Hisaaki Kato, Shiga, Japan

[73] Assignee: Murata Kikai Kabushiki Kaisha, Kyoto, Japan

[21] Appl. No.: 239,016

[22] Filed: Aug. 31, 1988

Related U.S. Application Data

[63] Continuation of Ser. No. 2,118, Jan. 12, 1987, abandoned.

[30] Foreign Application Priority Data

Jan. 16, 1986 [JP] Japan ..... 61-4970[U]

[51] Int. Cl.[5] ..... D01H 5/88

[52] U.S. Cl. ..... 57/328; 19/244

[58] Field of Search ..... 19/236, 244–252, 19/256, 253–255; 57/315, 328

[56] References Cited

U.S. PATENT DOCUMENTS

| | | | |
|---|---|---|---|
| 4,39,021 | 7/1983 | Kamel | 19/253 |
| 2,357,243 | 8/1944 | Walker | 19/252 |
| 2,751,631 | 6/1956 | Hunter et al. | 19/252 X |
| 2,942,306 | 6/1960 | Boer | 19/247 |
| 2,947,039 | 8/1960 | Rulon-Miller et al. | 19/251 X |
| 2,951,266 | 9/1960 | Burnham | 19/254 |
| 4,183,202 | 1/1980 | Morihashi | 57/328 |
| 4,290,170 | 9/1981 | Brookstein et al. | 57/315 X |
| 4,327,044 | 4/1982 | Dolan et al. | 19/244 X |
| 4,387,487 | 6/1983 | Nakahara et al. | 57/328 X |
| 4,445,252 | 5/1984 | Morihashi et al. | 19/244 |
| 4,520,532 | 6/1985 | Stalder et al. | 19/244 |
| 4,692,967 | 9/1987 | Dolan et al. | 19/244 |

*Primary Examiner*—Katherine Matecki

*Attorney, Agent, or Firm*—Spensley Horn Jubas & Lubitz

[57] ABSTRACT

A draft device in a spinning machine comprising a pair of back rollers, a pair of middle rollers each provided with an apron belt, and a pair of front rollers. An outer peripheral part of the driving-side of middle roller is formed of a rubber.

11 Claims, 2 Drawing Sheets

DRAFT DEVICE IN SPINNING MACHINE

This is a continuation of application Ser. No. 07/002,118 filed on Jan. 12, 1987, and now abandoned.

FIELD OF THE INVENTION AND RELATED ART STATEMENT

The present device relates to the structure of a draft device in a spinning machine.

The above-mentioned draft device comprises a plurality of pairs of rollers pressed against each other, in which, generally, a bottom roller disposed at an lower position is positively driven to rotate by a motor, while a top roller disposed at an upper position is rotated by being pressed against the bottom roller through a fiber bundle therebetween. In a three-line type draft device used in many spinning machines, the above-mentioned pairs of rollers are called back rollers, middle rollers and front rollers, and an endless rubber belt called apron belt is wrapped around the outer periphery of each of the middle rollers. The bottom rollers are each a single shaft used in common for all spindles, and the roller parts of the bottom rollers making contact with the fiber bundle are also formed of a metal. The outer periphery of the roller part is provided with fine grooves or roulette, in order to contrive secure engagement with the fiber bundle or the apron belt and sufficient transmission of a driving force. The top rollers for every two spindles are independently supported by a top roller support, and the outer periphery of a roller part of each thereof is formed of a rubber to provide a cushioning effect.

When the apron belts for the middle rollers are abraded due to contact thereof with the fiber bundle, the gripping of the fiber bundle by the apron belts becomes unstable, resulting in nonuniformity of the thickness of the yarn spun. Therefore, the abraded apron belt must be replaced with a new one upon abrasion thereof. In particular, the apron belt on the bottom roller side is ground on the back side thereof by the above-mentioned grooves or roulette provided on the outer peripheral surface of the roller, so that it suffers abrasion on both front and back sides thereof, resulting in a short useful life.

OBJECT AND SUMMARY OF THE INVENTION

It is an object of the present invention to provide an improved draft device for a spinning machine, in which an abrasion of an apron belt on bottom rollers can be eliminated.

The present invention is characterized in that in a draft device of a spinning machine comprising a pair of back rollers, a pair of middle rollers each provided with an apron belt, and a pair of front rollers, the outer peripheral surface of the middle roller on the driving side, namely, the middle bottom roller is formed of a rubber.

According to the present invention, with the outer periphery of the middle bottom roller formed of a rubber, slippage between the rubber and the apron belt is suppressed, so that a driving force can be securely transmitted from the middle bottom roller to the middle top roller through both apron belts. Therefore, it is unnecessary to provide the outer peripheral surface of the roller with the grooves or roulette, and the elasticity of the rubber prevents abrasion of the back side of the apron belt.

DETAILED DESCRIPTION OF PREFERRED EMBODIMENTS

Figure 3:
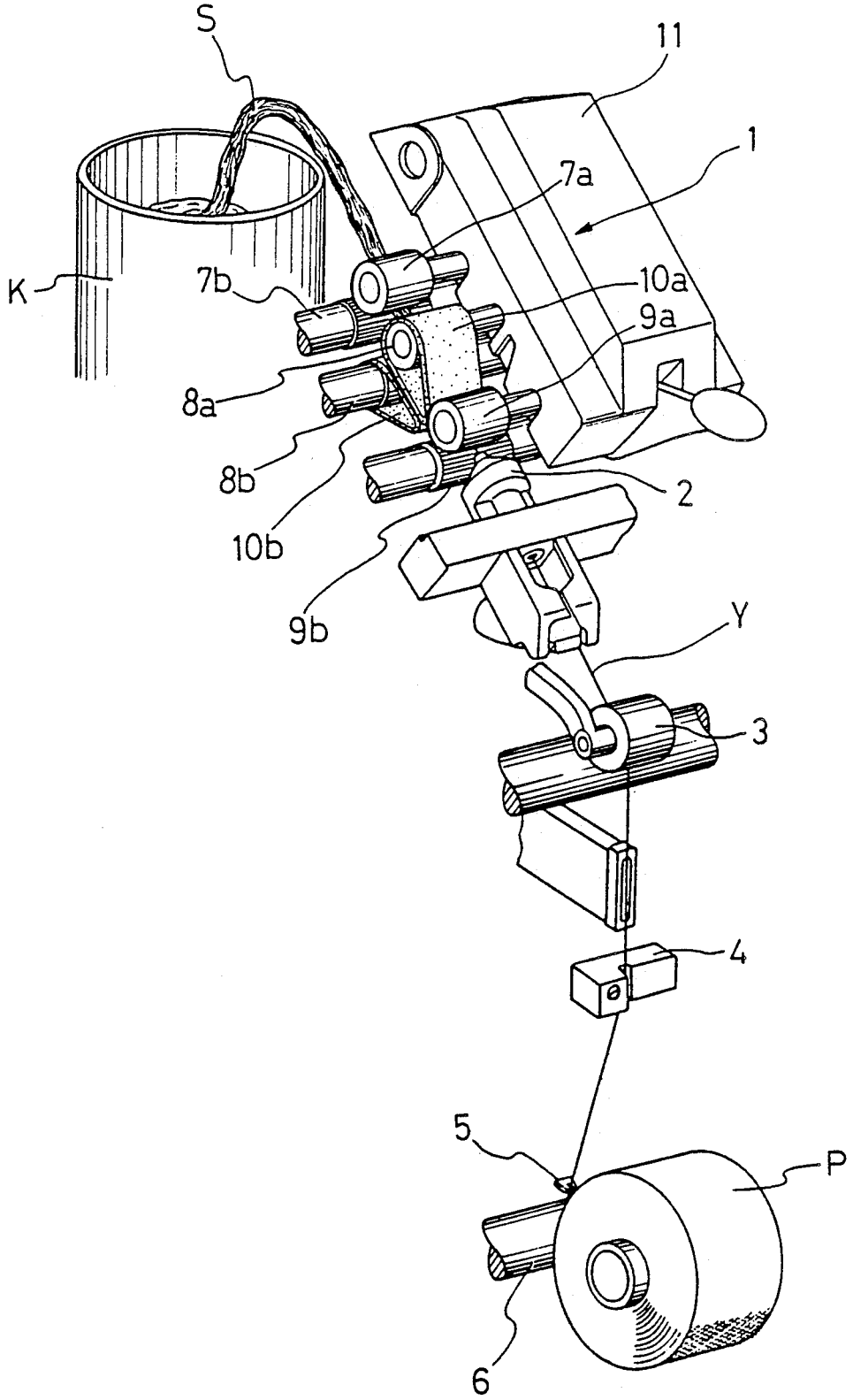
FIG. 3 shows a perspective view of a pneumatic spinning machine.

FIG. 3 schematically illustrates a pneumatic spinning machine. A nontwisted drawing sliver S drawn out of a can K is led through a draft device 1 into an air jet nozzle 2 to become a spun yarn Y, which is drawn out by a delivery roller 3, is passed through a slub catcher 4, and while being reciprocated by a traverse guide 5, is taken up onto a package P driven to rotate by a friction roller 6. The draft device 1 comprises three pairs of rollers, namely, back rollers 7*a*, 7*b*, middle rollers 8*a*, 8*b* and front rollers 9*a*, 9*b*, with rubber-made endless apron belts 10*a*, 10*b* wrapped respectively around the middle rollers 8*a*, 8*b*. The top rollers 7*a*, 8*a*, 9*a* disposed at upper positions are each independent for every two spindles as a unit, and are rotatably supported by a top roller support 11. The bottom rollers 7*b*, 8*b*, 9*b* disposed at lower positions are each a single shaft common for all spindles, and are driven to rotate at different circumferential velocities by drive sources (not shown). The top rollers and the bottom rollers are pressed against each other in vertical direction, and the top rollers are rotated by receiving driving forces from the bottom rollers through surface contact. Of the top roller and bottom rollers, the parts rotated in contact with each other are hereinafter referred to as "roller part". Each of the roller parts of the top rollers 7*a*, 8*a*, 9*a* has an outer periphery formed of a rubber, and the bottom rollers 7*b*, 8*b*, 9*b* each have an outer periphery formed of a metal, except the middle bottom roller 8*b*, and the peripheral surfaces thereof are provided with fine grooves or rugged patterns.

Figure 1:
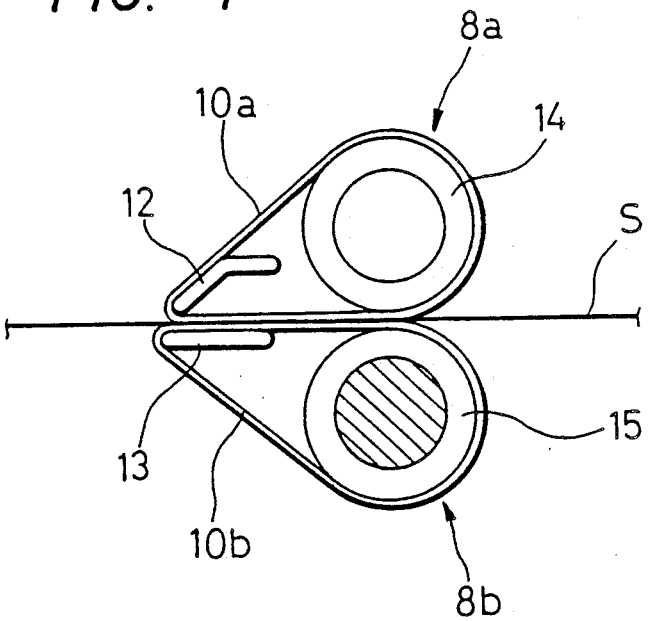
FIG. 1 shows a side view of middle rollers.
Figure 2:
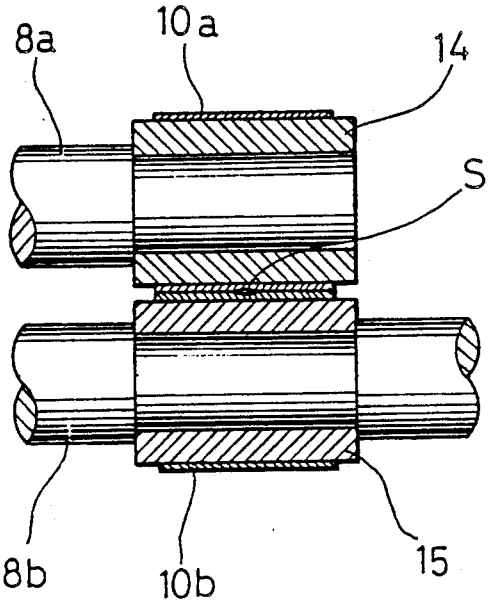
FIG. 2 shows a vertical cross-sectional front view of the middle rollers.

FIG. 1 shows a side view of the middle rollers 8*a*, 8*b*, and FIG. 2 shows a cross-sectional view of the same. Numerals 12, 13 denote tenser bars for tensioning the apron belts 10*a*, 10*b*, respectively, and numeral 14 denotes a rubber layer of the middle top roller 8*a*. In the present draft device, the middle bottom roller 8*b* is also provided with a rubber layer 15 at the outer periphery of its roller part, in the same manner as in the case of the top rollers 7*a*, 8*a*, 9*a*. The peripheral surface of each of the rubber layers 14, 15 is a smooth surface devoid of ruggedness, and the sliver S is clamped between the rubber layers 14, 15 through the apron belts 10*a*, 10*b*. The apron belts 10*a*, 10*b* and the rubber layers 14, 15 are all formed from NBR, and each rubber layer is about 5 mm in thickness.

The rotating driving force of the middle bottom roller 8*b* is transmitted sequentially through the apron belts 10*b*, 10*b* to the rubber layer 14 of the middle top roller 8*a*. Since the rubber layers and the apron belts are formed of a rubber, they do not slip in mutual contact, so that the driving force is securely transmitted without loss. Since the roller parts of the back rollers 7*a*, 7*b* and the front rollers 9*a*, 9*b* make direct contact with the sliver S, the outer periphery of the roller parts might be abraded; on the other hand, since the middle rollers 8*a*, 8*b* make contact with the sliver S through the apron belts 10*a*, 10*b*, the roller parts thereof are scarcely abraded even if the apron belts are abraded. Therefore, by replacing the apron belts 10*a*, 10*b*, when they have been abraded, with new apron belts in the conventional manner, normal draft operation can be performed. Since the peripheral surface of the rubber layer 15 is free of ruggedness and the elastic action of the rubber itself ensures a marked reduction in abrasion of the back side of the apron belt 10*b* as compared with that in a conventional design and ensures more assured gripping of the sliver, irregularity in draft is reduced.

The present draft device is particularly effective when used in a high-speed spinning machine in which the rotating speed of the rollers is high e.g., a pneumatic spinning machine, and the useful life of the apron belt 10*b* can be thereby prolonged to several times the conventional useful life. The materials for the apron belts and the rubber layers are not limited to NBR (nitryl-butadiene-rubber), and appropriate materials may be used through suitable selection; natural rubber or a rubber comprising a synthetic resin may be used. The present device may be applied not only to the three-line type draft device shown in the working example but to two-line or four-line or other types of draft device, and every draft devices in which the outer peripheral part of the driving-side draft roller provided with the apron belt is formed of a rubber are all included in the present invention.

According to the present invention, abrasion of the back side of the apron belts can be prevented, so that the useful life of the apron belts can be prolonged Accordingly, the present invention can contribute to production of uniform yarns with good quality.

I claim:

1. A draft device in a pneumatic spinning machine, comprising:

two apron belts, each apron belt composed of a rubber material, the two apron belts defining a sliver running path therebetween;

two rotatably driven rollers, each rotatably driven roller being associated with a respective one of the apron belts and having an outer peripheral surface composed of a rubber material and in contact with the associated apron belt for driving the associated apron belt.

2. A draft device in a pneumatic spinning machine, comprising:

a pair of back rollers, a pair of middle rollers, each of said middle rollers having an outer peripheral surface, a pair of apron belts, each of said apron belts being in driving contact with the outer peripheral surface of one of said middle rollers, and a pair of front rollers, wherein said outer peripheral surface of each of said middle rollers and said apron belts are composed of substantially identical rubber materials.

3. A draft device in a pneumatic spinning machine, comprising:

top and bottom back rollers pressed against each other, top and bottom middle rollers pressed against each other, each of said top and bottom middle rollers provided with an apron belt, top and bottom front rollers pressed against each other, and drive means for driving said bottom back rollers, said bottom middle rollers and said bottom front rollers whereby said top back rollers, said top middle rollers and said top front rollers are rotated by receiving driving force from the bottom back rollers, the bottom middle rollers and the bottom front rollers through surface contact, wherein the outer peripheral surface of said top and bottom middle rollers and said apron belts are composed of substantially identical rubber materials.

4. A draft device as claimed in claim 3, wherein said middle top roller and the middle bottom roller are provided with rubber layers at the outer periphery of their roller parts and the peripheral surface of each of the rubber layers is a smooth surface.

5. A draft as claimed in claim 4, wherein each of said rubber layers is about 5 mm in thickness.

6. A draft device as claimed in claim 4, wherein each of said apron belts and said rubber layers are formed from NBR (nitril-butadiene-rubber).

7. A draft device in a spinning machine, comprising:

a pair of rotatably driven rollers, each rotatably driven roller having an outer peripheral surface made of a rubber material;

a pair of apron belts, each apron belt being associated with a respective one of the rotatably driven rollers and each apron belt being made of said rubber material, each apron belt being in contact with said outer peripheral surface of the associated roller and defining a closed path around the associated roller;

whereby at least one of the rotatably driven rollers imparts a driving force on an associated apron belt for driving the associated apron belt about said closed path.

8. A draft device as claimed in claim 7 wherein said rubber material comprises nitril butadiene rubber.

9. A draft device as claimed in claim 7 wherein said spinning machine is a pneumatic spinning machine.

10. A draft device in a spinning machine, comprising:

first and second apron belts, each apron belt made of a rubber material and defining a closed path;

first and second rotatably driven rollers, each rotatable roller having an outer peripheral surface made of said rubber material, said first and second rollers being disposed within said closed paths defined by the first and second apron belts, respectively, said outer peripheral surface of said first roller being in driving contact with said first apron belt;

drive means for rotatably driving said first roller so as to drive said first apron belt about said closed path;

whereby the amount of slipping occurring between the rotatably driven first roller and the first apron belt is reduced by employing the same rubber material for the surface of the first roller which contacts the first apron belt as is employed for the first apron belt.

11. A draft device as claimed in claim 10, wherein the outer peripheral surface of the second roller is provided in contact with the second apron belt.

* * * * *